US010182610B2

(12) United States Patent
Hakkala

(10) Patent No.: US 10,182,610 B2
(45) Date of Patent: Jan. 22, 2019

(54) FEET POSITION GUIDANCE AID

(71) Applicant: FOOTBALANCE SYSTEM OY, Vantaa (FI)

(72) Inventor: Erkki Hakkala, Helsinki (FI)

(73) Assignee: FOOTBALANCE SYSTEM OY, Vantaa (FI)

( * ) Notice: Subject to any disclaimer, the term of this patent is extended or adjusted under 35 U.S.C. 154(b) by 0 days.

(21) Appl. No.: 15/323,201

(22) PCT Filed: Jun. 30, 2014

(86) PCT No.: PCT/FI2014/050540
§ 371 (c)(1),
(2) Date: Dec. 30, 2016

(87) PCT Pub. No.: WO2016/001474
PCT Pub. Date: Jan. 7, 2016

(65) Prior Publication Data
US 2017/0150775 A1 Jun. 1, 2017

(51) Int. Cl.
*A43B 7/28* (2006.01)
*A43B 7/14* (2006.01)
(Continued)

(52) U.S. Cl.
CPC ..... *A43B 7/28* (2013.01); *A43B 7/141* (2013.01); *A43B 13/04* (2013.01); *A43B 13/12* (2013.01);
(Continued)

(58) Field of Classification Search
CPC ..... A43B 7/28; A43B 7/141; A43B 7/145; A43B 7/1465; A43B 7/147; A43D 39/00
(Continued)

(56) References Cited

U.S. PATENT DOCUMENTS 4,450,122 A * 5/1984 Gallina ..... A43B 7/28 12/146 M
4,520,581 A * 6/1985 Irwin ..... A43B 7/28 12/142 N
(Continued)

FOREIGN PATENT DOCUMENTS

EP 0 511 803 A1 11/1992
FR 2748191 A1 11/1997
(Continued)

OTHER PUBLICATIONS

International Search Report, dated Mar. 5, 2015, from corresponding PCT Application.
(Continued)

*Primary Examiner* — Ted Kavanaugh
(74) *Attorney, Agent, or Firm* — Young & Thompson

(57) ABSTRACT

A feet position guidance aid for formulating individually formed thermoplastic insoles, shoes or shoe sole structures. The feet position guidance aid is made of flexible material and its upper surface includes guiding places for feet for guiding the position of the feet. The feet position guidance aid includes a lifter, wherein the lifter is a rising structure arranged to lift up and support the toes of the feet so that feet are guided to a position suitable for formulating the individually formed thermoplastic insole. An insole customizing arrangement for formulating individually formed thermoplastic insoles is also described.

6 Claims, 4 Drawing Sheets

(51) Int. Cl.

| | |
|---|---|
| ***A43D 1/02*** | (2006.01) |
| ***A43B 13/04*** | (2006.01) |
| ***A43B 13/12*** | (2006.01) |
| ***A43B 17/00*** | (2006.01) |
| ***A43B 17/14*** | (2006.01) |

(52) U.S. Cl.
CPC ..... *A43B 17/006* (2013.01); *A43B 17/14* (2013.01); *A43D 1/022* (2013.01)

(58) Field of Classification Search
USPC ..... 12/142 N, 146 B, 146 BR, 146 M
See application file for complete search history.

(56) References Cited

U.S. PATENT DOCUMENTS

| | | | | |
|---|---|---|---|---|
| 4,548,563 | A | 10/1985 | Aigrefeuille | |
| 4,888,841 | A * | 12/1989 | Cumberland | A43B 7/28 12/142 N |
| 5,027,461 | A | 7/1991 | Cumberland | |
| 6,769,148 | B1 * | 8/2004 | Emina | A43D 5/00 12/142 Q |
| 7,125,509 | B1 * | 10/2006 | Smith | A43B 7/28 264/223 |
| 2006/0076700 | A1 * | 4/2006 | Phillips | A43B 7/28 264/40.1 |
| 2009/0247909 | A1 * | 10/2009 | Mukumoto | A43B 7/28 600/592 |
| 2016/0288440 | A1 * | 10/2016 | Louko | A43B 17/006 |

FOREIGN PATENT DOCUMENTS

| | | | |
|---|---|---|---|
| GB | 165 104 | A | 12/1921 |
| WO | 2008/006929 | A1 | 1/2008 |

OTHER PUBLICATIONS

Extended European Search Report dated Dec. 4, 2017; Application No. 14896465.3.

* cited by examiner

FEET POSITION GUIDANCE AID

BACKGROUND

The present invention relates to a feet position guidance and an insole customizing arrangement for customizing a preform of an insole, a sole of a shoe or a shoe sole structure of a sandal.

BACKGROUND

Many people suffer from some sort of foot problems. An individual takes around 15 000-16 000 steps every day. Foot motion/gait problems reflect to soles, ankles, knees, hips, back, etc.; that is why their treatment and prevention is particularly beneficial to the whole human well-being. Provided that the foot position is correct, the load of the body is divided evenly and many problems caused by motion/gait can be avoided.

Different (arch) support insoles are available for correcting the foot position. Ready-made supports in the insoles do not generally provide a perfect match to anyone's feet, as people do not generally bear identical feet shape. Accordingly, many support insoles are ultimately deemed inconvenient due to their lousy fit. Only few of the people suffering from foot problems have had a chance to purchase insoles that alleviate at least part of the problems. Traditionally, custom-made shoes and insoles have been manufactured by professional shoemakers, physiotherapists, or podiatrists. Measuring the feet and manufacturing the insoles requires experts and/or expensive and specialized apparatuses.

SUMMARY

Now there has been invented an improved feet position guidance aid and an insole customizing arrangement for formulating individually formed thermoplastic insoles, soles of shoes or shoe sole structures of sandals. The improved feet position guidance aid and the insole customizing arrangement are characterized by what is stated in the independent claims. Various embodiments of the invention are disclosed in the dependent claims.

According to a first aspect, there is provided a feet position guidance aid for formulating at least one individually formed thermoplastic insole, wherein the feet position guidance aid is made of flexible material. The upper surface of the feet position guidance aid comprises at least one guiding place for at least one foot for guiding the position of said at least one foot arranged on the guiding place of the upper surface of the feet position guidance aid. The upper surface comprises at least a lifter, wherein the lifter is a rising structure arranged to lift up and support the toes of said at least one foot so that said at least one foot is guided to a position suitable for formulating the individually formed thermoplastic insole.

According to an embodiment, the upper surface further comprises a toe joint basin and wherein the toe joint basin is arranged next to the lifter and wherein the toe joint basin is a socket for a toe joint of said at least one foot for further guiding said at least one foot to a position suitable for formulating the individually formed thermoplastic insole. According to an embodiment, the feet position guidance aid comprises two guiding places for both feet and wherein there is a groove between said guiding places. According to an embodiment, the upper surface further comprises at least one substrate arranged to support said at least one foot from toe joint to the heel. According to an embodiment, said at least one substrate comprises a protrusion for a plantar arch. According to an embodiment, the feet position guidance aid comprises guidance lines for heels, wherein said guidance lines are small notches in the material of the feet position guidance aid. According to an embodiment, the feet position guidance aid is made of polyurethane. According to an embodiment, the lifter is formed curved so that edge of the lifter is closer to the bigger toe than the smaller toe.

According to a second aspect, there is provided an insole customizing arrangement for formulating at least one individually formed thermoplastic insole, wherein the insole customizing arrangement comprises at least a feet position guidance aid according to any of the above mentioned embodiments and at least one thermoplastic insole preform. Said at least one thermoplastic insole preform is arranged to be positioned on one of said at least one guiding place of a feet position guidance aid.

According to an embodiment, said at least one thermoplastic insole preform is arranged to be heated over the glass transition temperature of the included thermoplastic before formulating said at least one thermoplastic insole preform.

DESCRIPTION OF THE DRAWINGS

In the following, various embodiments of the invention will be described in more detail with reference to the appended drawings, in which.

DESCRIPTION OF EXAMPLE EMBODIMENTS

Figure 1:
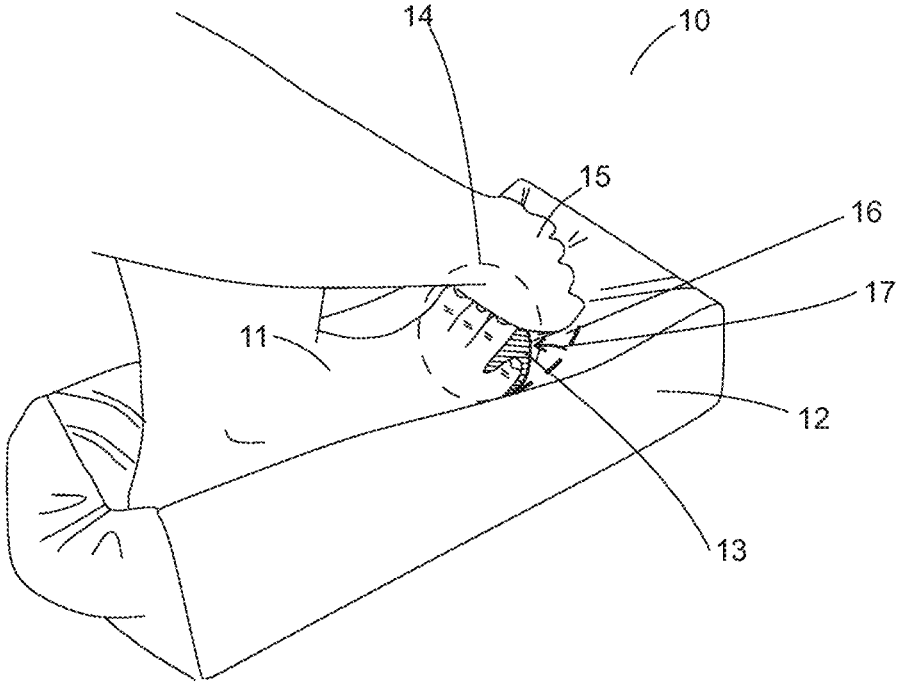
FIG. 1 shows an example of an insole customizing arrangement for customizing a preform of an insole.

Thermoplastic material has been found to be a functional and practical material in customizable, personalizable, individual insoles. A thermoplastic insole preform (blanket) is easily formable and it also maintains its shape after formulation. A thermoplastic insole preform is an insole preform arranged to be formed to a customized insole for a shoe and comprising thermoplastic material.

A thermoplastic insole preform has at least one layer, which is made of thermoplastic and reaches out at least from under the heel to under the plantar arch of the target person's, hereinafter user, foot. Advantageously two or three material layers that are connected together are used in the perform insole for the comfort of the user. The upper layer (if used) of the insole preform is placed against the foot and the lower layer is placed against the shoe. Materials of these two layers can be selected among any prior art materials used in insoles. For example, the lower layer may be constructed from a known material such as Rheluflex (trademark of Rhenoflex GmbH Ltd) comprising non-woven polyester as a carrier, ionomerresin-ethylvinylacetate blend as an extruded core, and EVA-Hotmelt as an adhesive.

The middle layer of the insole (in case of three layers) is made of thermoplastic. The thermoplastic used can be selected from a large group of known thermoplastics. The critical value is the temperature, so-called glass transition temperature, where the thermoplastic becomes plastic and, on the other hand, turns back to solid form when the temperature decreases after shaping the insole. This temperature should not generally be so high that the insole feels uncomfortable against the user's foot. Notwithstanding a high glass transition temperature, a thermoplastic is still applicable if it can be cooled down enough prior to placing in contact with the foot, provided that the thermoplastic remains plastic, i.e. mouldable. Adequate temperature for the thermoplastic to become plastic is preferably somewhere under 95° C. and above 45° C. Advantageously the range is from 50° C. to 85° C. Suitable materials that become or are plastic within the preferred ranges are, for example, thermoplastic polyesters A-PET (Amorphous polyester terephthalate) and PETG (glycol-modified polyethylene terephthalate, which is a copolyester), or such with essentially similar characteristics. Also e.g. ABS (acrylonitrile butadiene styrene), PVC (polyvinyl chloride) can be used.

Thickness of the thermoplastic layer shall be preferably selected to provide reasonable support to the user's foot when the layer is in a rigid state. The thickness may also vary throughout the layer, if e.g. more flexibility is desired below the toe area (thinner) than the plantar arch area (thicker).

Other characteristic required for the thermoplastic dictates that it should be rigid under the melting temperature.

One aspect of the invention relates to formulating an individual insole for a shoe from a thermoplastic insole preform by using a feet position guidance aid, wherein the insole preform that is ready in one piece (thus possibly having separate layers that are connected together with adhesive or such) and easy to heat over the glass transition temperature of the included thermoplastic for formulation. After formulation, the formulated individual insole for a shoe is cooled and the cooled insole is preferably rigid one-piece structure that corrects the foot position and supports the foot, especially the plantar arch and transverse arch thereof.

Alternatively, a personalised shoe can be provided, said shoe having a sole, which can be shaped according to user's foot by using a feet position guidance aid for correcting the incorrect position thereof. The shoe in this case may have at least one material layer of thermoplastic. The shoe is advantageously manufactured to include all necessary layers and is just personalized by the feet position guidance aid upon purchase. Suitable shoes include, for example, various types of walking shoes, sport shoes, boots, sandals and soft gym shoes.

The sole is advantageously at least a two-piece structure including a thermoplastic layer either situated on top of the sole material or being integrated, for example embedded, within it. The one or more sole layers excluding the thermoplastic layer may comprise e.g. EVA (ethylvinylacetate) or other prior art materials; e.g. aforesaid EVA is even available in different hardnesses. If there is more than one layer the thermoplastic layer may be smaller in lateral direction than the whole sole. The thermoplastic layer reaches out at least from under the heel to under the plantar arch of the foot the same way as with the insole. The thermoplastic materials may be selected the same way as with the insole. It may be advantageous to make at least the outer surface of the sole of some wear resistant and good friction characteristics-having material. Optionally, e.g. viscoelastic foam or other material, which may also be thermosensitive, may be used within the shoe, whereby the shoe internals also reshape in addition to mere insole and provide additional comfort/support. By the feet position guidance aid can be produced very comfortable personalised shoe that supports tightly the bone structure of the feet and ankle. This is very important if the user has a for example diabetes or rheumatism and the shoe shouldn't cause any friction or abnormal pressure to the foot.

In a further alternative, footwear such as shoes (walking, sports, discipline-specific, etc.), skates, ski boots, etc. may be offered with preinstalled insoles, which insoles may then be personalized before use by the feet position guidance aid. The layers inside the shoe that receive the insole of the invention shall advantageously conform to the insole shapes. Optionally, e.g. viscoelastic foam or other material that is optionally thermosensitive can be used within the shoe, whereby the shoe internals also reshape in addition to mere insole.

In this context term "insole" may refer in addition to insoles also to thermoplastic soles of shoes that are arranged to be formulated to individual soles of shoes. A feet position guidance aid according to the invention may also be used for customizing a shoe sole structure of a sandal comprising thermoplastic material. In this case, the whole shoe sole structure is heated and arranged on the feet position guidance aid for formulation. After the formulation the whole shoe sole structure forms an individual supporting structure for a foot.

FIG. 1 shows an example of an insole preform customizing arrangement 10 for customizing an insole preform 13. The insole preform 13 arranged to be customized to individual support insole comprises thermoplastic material. The insole preform 13 is heated over the glass transition temperature of the included thermoplastic before customizing the insole preform 13. For customizing the insole preform 13 a foot 11 is placed on a rectangular pillow 12 so that the heated insole preform 13 arranged to be customized is between the foot 11 and the pillow 12. The rectangular pillow 12 has a flat i.e. unshaped surface and regular form. Further to this, for customizing the heated insole preform 13, an insole formulating professional is arranged to angle the foot 11 by pulling the front part of the insole preform 13 and toes 14 on the front part of the insole preform 13 upwards and backwards by hand 15 so that the front part of the insole 13 and toes 14 on the front part of the insole preform 13 bend up from the pillow 12 to the formulating position. The formulating position is a position in which the foot is in proper position for formulating a customized insole. The original position 16 of the insole preform 13 on the pillow 12 before angling the foot 11 is shown by dashed line and the direction of movement from the original position 16 to the formulating position is shown by an arrow 17.

The pillow 12 of this example may be made of three different viscoelastic foams. In this example is only shown customizing an insole for one foot. However, an insole for the other foot can be customized correspondingly.

Figure 2:
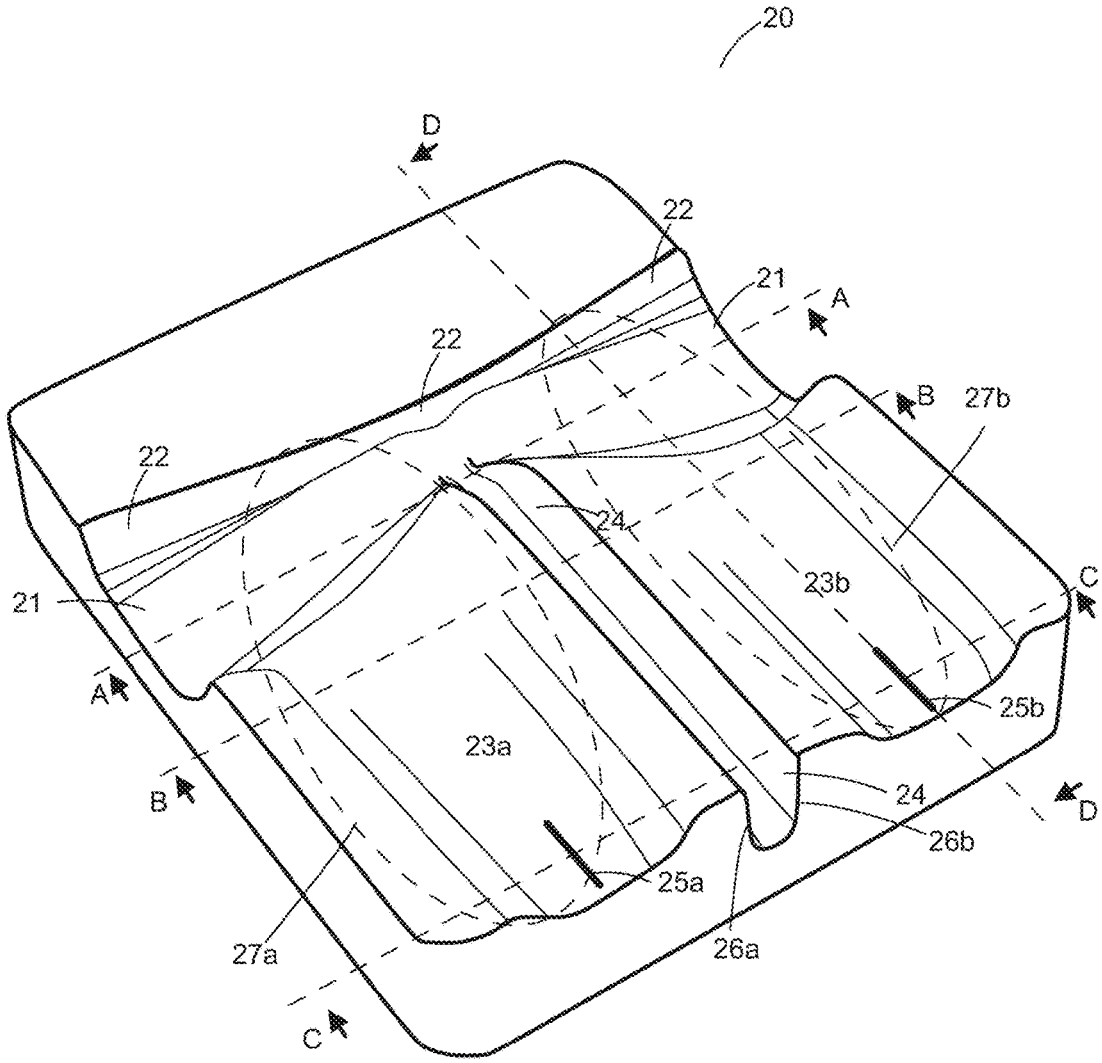
FIG. 2 shows a perspective view of an example of a feet position guidance aid for customizing a preform of an insole according to an embodiment of the invention.

FIG. 2 shows a perspective view of an example of a feet position guidance aid 20 for customizing an insole preform to an individual supporting insole according to an embodiment of the invention. The feet position guidance aid 20 structure comprises a toe joint basin 21, a lifter 22, substrates 23*a*, 23*b* for both feet, a groove 24 between the substrates 23*a*, 23*b* and guidance lines 25*a*, 25*b* for heels. Feet of a user of the feet position guidance aid 20 are arranged to be placed on the feet position guidance aid 20 so that toe joints place themselves to the toe joint basin 21 acting as socket for toe joints so that toes of both feet lift up against the lifter 22 acting as a rising structure and supporting surface for ensuring a proper high position for the plantar arch and transverse arch thereof. The adjusting of the plantar arch to a proper high position may be called Windlass effect and due this Windlass effect the foot/feet are in the formulating position. The toe joint basin 21 reaches from side to side as well the lifter 22 and they are common structures for both feet. The lifter 22 may be formed curved so that edge of the lifter 22 is closer to the bigger toe than the smaller toe, because the bigger toe needs to be lifted up, raised, stronger than the smaller toe.

Other parts of the feet i.e. the parts from the toe joint to the heel are arranged to be placed on substrates 23*a*, 23*b*. The substrates 23*a*, 23*b* may comprise shaping(s) that supports the other part of the feet, for example, there may be a protrusion for a plantar arch etc. In addition, guidance lines 25*a*, 25*b* for heels are arranged to heel parts of the substrates 23*a*, 23*b*. The guidance lines 25*a*, 25*b* may be, for example, small notches in the material of the feet position guidance aid 20. The guidance lines 25*a*, 25*b* are arranged to indicate proper places for the heels when placing feet to the feet position guidance aid 20 so that when seen from back i.e. behind the feet, the guidance line 25*a* is in the centerline of the heel of the left foot and the guidance line 25*b* is in the centerline of the heel of the right foot. The guidance lines 25*a*, 25*b* may also indicate proper places for insoles which comprise locating marks in heel area of the insole indicating centerline.

The groove 24 reaches from back of the feet position guidance aid 20 to the toe joint basin 21. The groove 24 separates the foot guiding places and therefore also substrates 23*a*, 23*b*. The groove 24 also enables pressing of inner walls of the substrates 23*a*, 23*b* against a foot when feet are placed on the substrates 23*a*, 23*b* i.e. the groove 24 enables a flexible structure for feet position guidance aid 20 in its own part. Also inner walls 26*a*, 26*b* of substrates 23*a*, 23*b* are shown.

The feet position guidance aid 20 comprises separate places, guiding places, 27*a*, 27*b* for feet and the feet position guidance aid 20 is arranged to be used for both feet simultaneously. However, it is also possible to use only one guiding place 27*a* or 27*b* of the feet position guidance aid 20 at a time.

When toes are lifted up, the feet are in formulation position, in which position the feet position guidance aid 20 is arranged to be used to formulate i.e. customize a heated thermoplastic insole preform(s) that is arranged between a foot and the feet position guidance aid 20. For customization, insole preform(s) is again heated over the glass transition temperature of the included thermoplastic.

The feet position guidance aid 20 is arranged to work with different sized feet and insole preform(s). This is due to its formulation and size but also its material. The length (that is the longitudinal direction of foot, when foot is arranged in its place on the feet position guidance aid 20) of the feet position guidance aid 20 may be, for example around 50 cm, for example, 45 cm-55 cm and width may be, for example around 40 cm, for example, 37 cm-43 cm. However, it is possible to widen or narrow and/or lengthen or shorten the feet position guidance aid 20 if needed. The feet position guidance aid 20 may be made of, for example, polyurethane (PU), which is open cell foam and flexible material that shapes based on pressure. Suitable hardness shore for the PU material may be, for example, 10. However, it is also possible to use some other suitable material. The feet position guidance aid 20 may also be coated by some material, for example, by leather or leather-like material.

Figure 3A:
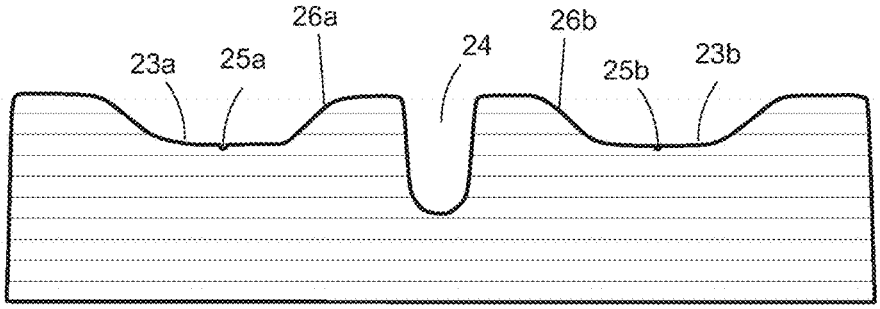
FIG. 3*a-d* shows a cross-sectional view of the feet position guidance aid of FIG. 2.
Figure 3B:
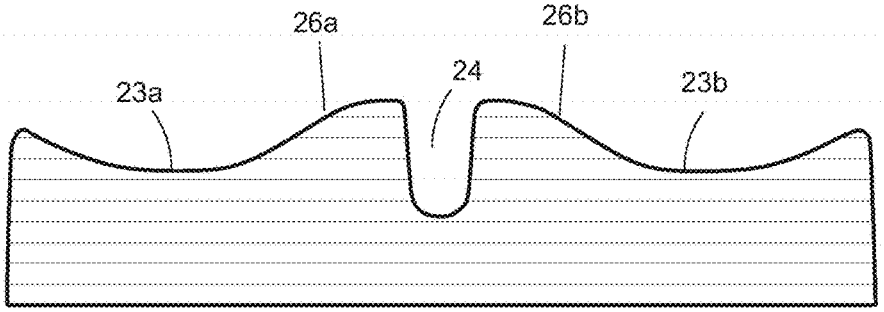
Figure 3C:
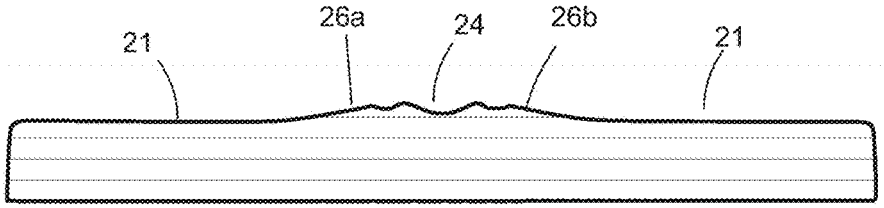
Figure 3D:
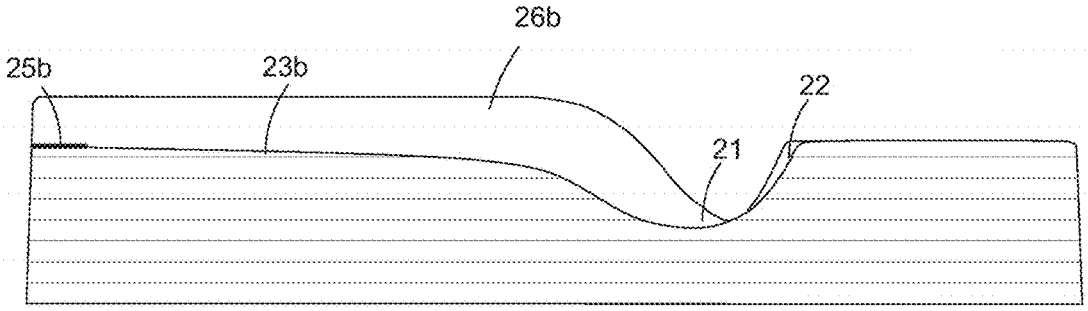

FIG. 3*a, b, c*, and *d* shows a cross-sectional view of the feet position guidance aid 20 of FIG. 2 in the points A-A (FIG. 3*a*), B-B (FIG. 3*b*), C-C (FIG. 3*c*), and D-D (FIG. 3*d*). Sectional surfaces of all these cross-sectional views are hatched. FIG. 3*a* shows substrates 23*a*, 23*b* for both feet, the groove 24 between the substrates 23*a*, 23*b* and guidance lines 25*a*, 25*b* for heels. Also inner walls 26*a*, 26*b* of substrates 23*a*, 23*b* are shown. FIG. 3*b* shows substrates 23*a*, 23*b* for both feet, the groove 24 between the substrates 23*a*, 23*b* and inner walls 26*a*, 26*b* of substrates 23*a*, 23*b*. FIG. 3*c* shows the toe joint basin 21 and end of the groove 24 and end of the inner walls 26*a*, 26*b* of substrates 23*a*, 23*b*. FIG. 3*d* shows the toe joint basin 21, lifter 22, the guidance line 25*b* for the right heel and substrate 23*b* for the right foot as well as the inner wall of the substrate 23*b*.

Figure 4:
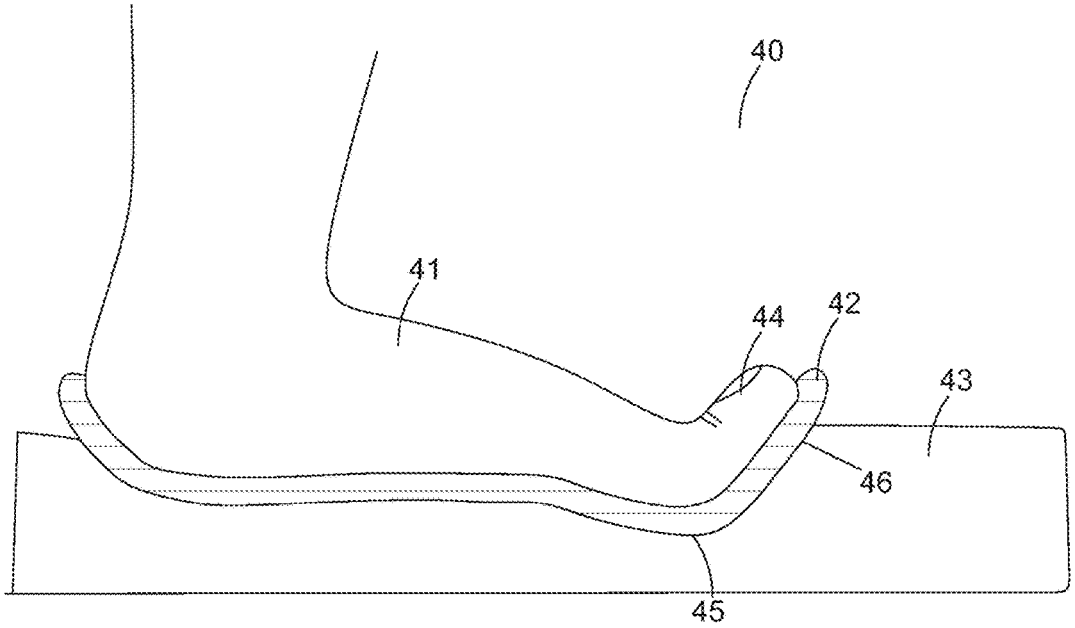
FIG. 4 shows an example of an insole customizing arrangement for customizing a preform of an insole according to an embodiment of the invention.

FIG. 4 shows an example of an insole customizing arrangement 40 with a foot for customizing an insole preform 42 from a side according to an embodiment of the invention. The insole preform 42 arranged to be customized to an individual support insole comprises thermoplastic material. For customization, the insole preform 42 is heated over the glass transition temperature of the included thermoplastic before customization. In customization a foot 41 is placed on the heated insole preform 42 and the insole preform 42 is placed on a feet position guidance aid 43 so that the insole 42 remains between the foot 41 and the feet position guidance aid 43. The feet position guidance aid 43 angles the foot 41 by guiding the front part of the insole preform 42 and toes 44 on the front part of the insole preform 42 upwards automatically when the foot is arranged on its place on the feet position guidance aid 43 so that the front part of the insole preform 42 and toes 44 on the front part of the insole preform 42 bend up to the formulating position without the help of an insole formulating professional or other manual guiding. Design of the feet position guidance aid 43, especially the toe joint basin 45 and lifter 46, lifts the user's toes 44 up by supporting the toes 44 against the lifter 46 of the feet position guidance aid 43 so that the plantar arch of the foot 41 is guided to a proper high position i.e. to a formulating position. The toe joint basin 45, for example, eases the correct positioning of the feet to the feet position guidance aid 43. It may also be that the feet position guidance aid 43 does not comprise a toe joint basin 45. The ready customized insole may be cooled after above mentioned customization i.e. use of the feet position guidance aid 43 so that the insole may retain its achieved customized form.

In this example is shown only customizing of the insole preform 42 for one foot by means of the feet position guidance aid 43 which comprises places for both feet like in FIG. 2. In this case, an insole for the other foot may be customized correspondingly by the other side of the feet position guidance aid 43. When the feet position guidance aid 43 comprises formulation places for two insole preforms (both feet) customization of insoles for both feet can be formed simultaneously.

It is also possible that the feet position guidance aid is actually a foot positioning guidance aid comprising only one place for one foot, in which case, by using two different single foot position guidance aids, one for the left foot and the other for the right foot, individually formed support insoles may be formed for both feet.

Basically, a feet position guidance aid according to some example of the invention is a flexible cushion where upper surface is ready-formed for shapes of a foot or both feet. The idea of at least one of these shapes is to guide a foot or feet to a position(s) suitable for formulating/customizing a proper individually formed support insole(s) from a heated thermoplastic insole preform(s) while the foot/feet are on the feet position guidance aid and insole preform(s) is/are between the foot/feet and the feet position guidance aid. Especially the lifter, but also the toe joint basin, ensures a proper high position for the plantar arch and transverse arch by lifting up toes automatically, without a professional's help, when the user is standing on the cushion. This proper high position for the plantar arch and transverse arch enables formulating of an individual support insole correcting the foot position. In addition, insoles may further comprise a locating mark(s) indicating, which part of the insole should be aligned to the toe joint basin of a feet position guidance aid.

There may exist pillows that are used for formulating support insoles without a professional's help. However, those existing pillows do not contain guiding shapes of the present invention, such as a toe joint basin or lifter, and therefore they may not formulate support insoles correctly.

It is obvious that the present invention is not limited solely to the above-presented embodiments, but it can be modified within the scope of the appended claims.

The invention claimed is:

1. A feet position guidance aid for formulating at least one individually-formed thermoplastic insole, the feet position guidance aid being made of flexible material, the feet position guidance aid comprising:

an upper surface comprising guiding places for feet, the guiding places being configured to guide the position of a respective foot on a respective one of the guiding places;

a lifter, that is a rising structure in front of a toe joint basin configured as a socket to receive toe joints of the feet, the lifter being configured to lift up and support toes of at least one foot of the feet so that said at least one foot is guided to a position configured to formulate the individually-formed thermoplastic insole when the at least one foot is received in the feet position guidance aid, the lifter comprising a curved front edge, with respect to a front end of the feet position guidance aid, the curved front edge being configured to be closer to a bigger one of the toes of the at least one foot than a smaller one of the toes of the at least one foot when the at least one foot is positioned in a respective one of the guiding places; and a groove between the guiding places reaching from a back end of the feet position guidance aid to the toe joint basin, the back end of the feet position guidance aid being opposite the front end of the feet position guidance aid.

2. The feet position guidance aid according to claim 1, wherein the upper surface further comprises at least one substrate configured to support said at least one foot from the toe joints of the at least one foot to a heel of the at least one foot.

3. The feet position guidance aid according to claim 2, wherein said at least one substrate comprises a protrusion for a plantar arch.

4. The feet position guidance aid according to claim 1, further comprising guidance lines for heels, said guidance lines being small notches in the material of the feet position guidance aid.

5. The feet position guidance aid according to claim 1, wherein the feet position guidance aid is made of polyurethane.

6. The feet position guidance aid according to claim 2, wherein the at least one substrate comprises two substrates each configured to support one of the feet from the toe joints of the feet to heels of the feet, the groove being defined in the feet position guidance aid between the two substrates.

* * * * *